United States Patent [19]

Shimoya

[11] 4,349,800

[45] Sep. 14, 1982

[54] MAGNETIC PROXIMITY SWITCH

[75] Inventor: Shigeo Shimoya, Tokyo, Japan

[73] Assignee: Kobishi Electric Co., Ltd., Japan

[21] Appl. No.: 98,637

[22] Filed: Nov. 29, 1979

[30] Foreign Application Priority Data

Jul. 6, 1979 [JP] Japan ..... 54-85778

[51] Int. Cl.[3] ..... H01H 9/00

[52] U.S. Cl. ..... 335/207; 335/205

[58] Field of Search ..... 335/205, 206, 207

[56] References Cited

U.S. PATENT DOCUMENTS 3,161,742 12/1964 Bagno ..... 335/207 X
3,205,323 9/1965 Deshautreaux ..... 335/207
4,039,985 8/1977 Shlesinger et al. ..... 335/207 X
4,165,935 8/1979 Bongort ..... 335/207
4,186,362 1/1980 Kondo et al. ..... 335/207 X

*Primary Examiner*—George Harris
*Attorney, Agent, or Firm*—Kane, Dalsimer, Kane, Sullivan and Kurucz

[57] ABSTRACT

An improved magnetic proximity switch which comprises an auxiliary permanent magnet for retaining normal closing and a yoke arranged so that the magnetic path of said auxiliary permanent magnet and the magnetic path formed by the magnetic flux from outside are added each other. Thus, the switch has such merits that the contact pressure at the time of normal closing is raised, the working sensitivity is enhanced, with a small external magnet, without mis-working due to shock or vibration from outside and the like.

2 Claims, 4 Drawing Figures

MAGNETIC PROXIMITY SWITCH

BACKGROUND OF THE INVENTION

In a conventional magnetic proximity switch, an armature having a center contact is biased by a spring on the side of normal closing contact to retain the contact between a center contact and the normal closing contact, while a permanent magnet is brought near to the switch from outside thereof to pull the armature to the side of normal opening contact against the biasing force of said spring thus to contact both contacts so as to contact the center contact with the side of normal opening contact.

Namely, as shown in FIG. 1, within a case 1 made of synthetic resin and the like, one side of a center contact 3 mounted on an armature 2 is biased by a spring 4 on the side of normal closing contact 5 to retain the contact between both contacts. A permanent magnet 7 may be brought near to the case from the outside (from above in FIG. 1) to pull the armature 2 against the biasing force of the spring 4 thus to contact the center contact 3 with normal opening contact 6.

However, said conventional magnetic switch has disadvantage that when the spring 4 takes large elasticity to enhance contact pressure of both contacts at the time of normal closing, the switch does not work unless the permanent magnet is brought nearer to the case 1 or the magnetic force of the permanent magnet itself is made larger. In short, there is involved a conflicting problem that when positive contact between both contacts at the time of normal closing is assured, the working sensitivity of the switch (the distance between the switch and the permanent magnet) becomes poor.

SUMMARY OF THE INVENTION

This invention is made in view of above mentioned circumstances. It is constructed so that at the time of normal closing, the center contact of an armature is contacted with normal closing contact by means of an auxiliary permanent magnet, and at the time of normal opening, magnetic flux from outside and magnetic flux of said auxiliary permanent magnet form a magnetic circuit passing through the armature and both flux will be added each other, so that the invention has its object to provide a novel magnetic proximity switch which can enhance contact pressure as well as improve working sensitivity at the time of normal closing.

DESCRIPTION OF THE PREFERRED EMBODIMENTS

Figure 1:
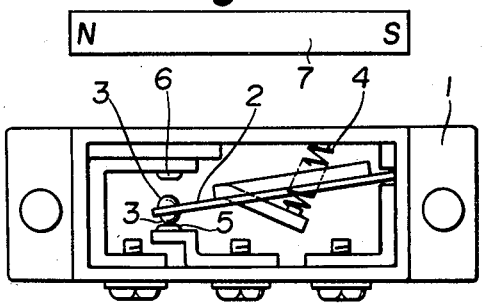
Fig. 1 (PRIOR ART)
FIG. 1 is a schematic view, showing a conventional (prior art) magnetic proximity switch.
Figure 2:
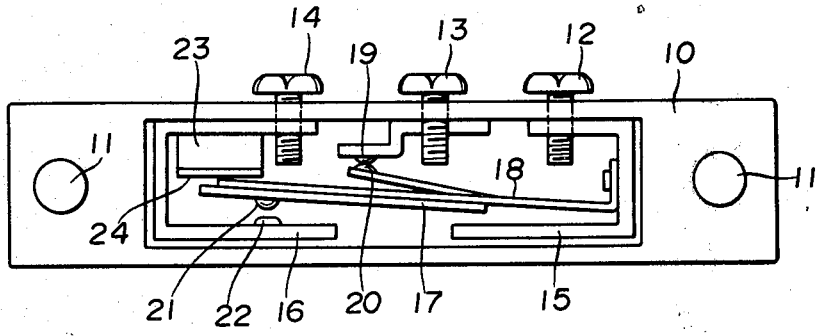
FIG. 2 is a schematic view, showing an embodiment of a magnetic proximity switch according to this invention.

In FIG. 2, reference numeral 10 designates a case which accomodates a magnetic proximity switch and made of non-magnetic material of synthetic resin and the like. Reference numerals 11 designate through holes for attaching the case 10. In the case 10, a screw to be a center terminal 12, a screw to be a normal closing terminal 13 and a screw to be a normal opening terminal 14 are respectively shown. On the center terminal 12 and on the normal opening terminal, each end of a center yoke 15 and of a normal opening yoke 16 having a channel shaped section and made of magnetic material is respectively fixed to said screws, while other ends of said yokes are arranged along inner wall of the case facing each other. Further, one end of an armature 18 is fixed to the center yoke 15 and on said armature 18, another armature 17 is fixed at a position nearly below said normal closing terminal 13 and said normal opening terminal 14. Said armature 18 is made of plate spring and provided with the first center contact 20 at its central position and said contact 20 contacts with a normal closing contact 19 which is electrically connected with said normal closing terminal. On the other hand, the second center contact 21 is provided below the side of the normal opening terminal 14 of the armature yoke 17 so that said contact 21 will contact with a normal opening contact 22, which is provided on said normal opening yoke 16, at the time of normal opening. Above said armature yoke 17 provided with the second center contact 21, an auxiliary permanent magnet 23 with a film-like insulator 24 being attached to the side of said armature yoke 17, being adhered to said normal opening yoke 16. And the armature 18 is energized upward by this auxiliary permanent magnet 23 at that time of normal closing to keep the contact between the normal closing contact 19 and the first center contact 20, thus to make electrical conduction between the normal closing terminal and the center terminal 12.

In the following, the operation of a magnetic proximity switch having above mentioned construction will be explained.

Figure 3:
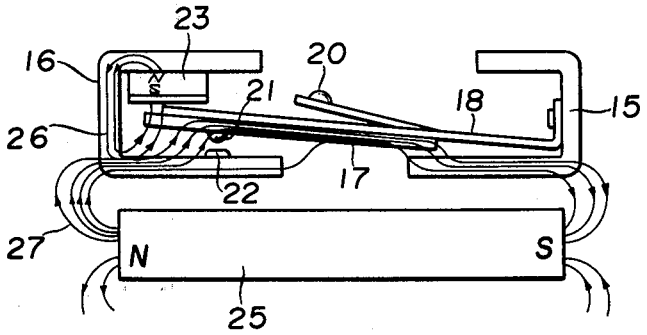
FIG. 3 is an explanatory drawing, showing magnetic path of the embodiment shown in FIG. 2.

At the time of normal closing, when S-pole and N-pole of the auxiliary permanent magnet 23 are arranged as shown in FIG. 3, magnetic flux 26 of the auxiliary permanent magnet 23 (hereinafter called as bias magnetic flux) tends to the direction of arrows in the drawing, forming magnetic paths from the N-pole to the S-pole via the normal opening yoke 16 and the armature yoke 17. So that, the armature yoke 17 is attracted to the side of the auxiliary permanent magnet 23 to contact the first center contact 20 with the normal closing contact 19.

On the other hand, at the time of normal opening, when an external magnet 25 is brought near to the side of the armature 18 from outside of the case 10, external flux 27 emitted from the external magnet 25 form magnetic paths from the N-pole to the S-pole via the normal opening yoke 16, the armature yoke 17 and the center yoke 15. The magnetic flux density in the armature yoke 17 of the external magnetic flux 27 is larger than the magnetic flux density in the armature yoke 17 of the bias magnet flux 26 and the armature 18 is attracted to the side of the normal opening yoke 16 as well as directions of magnetic line of force of the external magnetic flux 27 and of the bias magnetic flux 26 become same in the armature 18 and added each other, thus said attraction will be easily effected.

Figure 4:
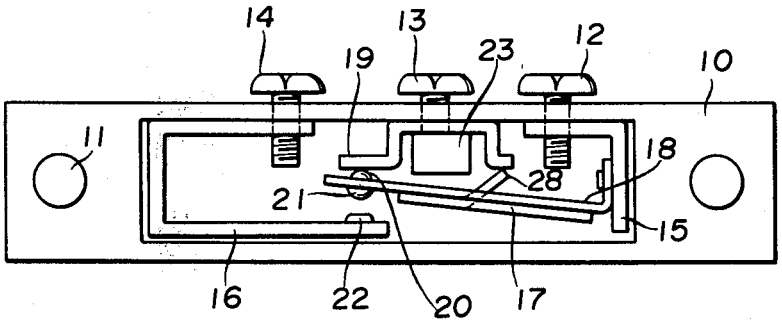
FIG. 4 is a schematic view, showing another embodiment of the switch.

FIG. 4 shows another example of this invention, and reference numbers shown in this figure designate same components as those used in the embodiment in FIG. 2. In this embodiment, the armature yoke 17 has a branched projection 28 on the side of the normal closing terminal 13, which projection 28 forms a part of magnetic path of the auxiliary permanent magnet 28 at the time of normal closing. The working principle of this embodiment is same as the embodiment in FIG. 2, so that explanation thereof will be omitted.

As above mentioned in detail, the magnetic proximity switch according to this invention is so constructed that the magnetic flux from outside and the magnetic flux from the auxiliary permanent magnet will work multicatively at the time of normal opening, thus having following merits.

(a) Even though the contact pressure is made higher at the time of normal closing, the working sensibility at the time of normal opening can be made higher.

(b) Normal closing is retained not by a spring but by a permanent magnet, so that quality control thereof is easily effected.

(c) Freeze-up due to residual magnetism is none at all.

(d) Misworking due to any shock or vibration from outside will never take place.

(e) To obtain same working sensitivity as usual one, the external magnet may be made smaller. Conversely, in case of same external magnet being used, it is possible to make the contact pressure four times and yet to enhance the working sensitivity.

What is claimed is:

1. A magnetic proximity switch which comprises:

a. a casing of non-magnetic material;

b. a pair of first and second yokes of magnetic material having a channel-shaped cross-section and open toward each other and secured to said casing in spaced apart relation to each other;

c. an armature of resilient material with an armature yoke adhered thereto along the length thereof and secured to said first yoke at one end thereof, said armature being movable between open and closed positions of the switch and extending into said second yoke;

d. a first permanent magnet secured to one arm of said channel-shaped second yoke and disposed on one side of said armature so that magnetic flux lines of said magnet pass through said second yoke and said armature yoke to normally magnetically bias said armature yoke into the closed position; and e. a second permanent magnet disposed exteriorly of said casing and one the other side of said armature, said second magnet being movable toward said yokes so that magnetic flux lines of said second magnet pass through said second yoke, said armature yoke and said first yoke to magnetically bias said armature yoke into the open position, the magnetic flux lines of said first and second magnets being in the same direction in said armature yoke to enhance the magnetic biasing of said armature yoke into the open position.

2. A magnetic proximity switch according to claim 1, in which said second yoke has a generally channel-shaped cross-section and opens toward said armature, said first permanent magnet being secured to the base of said channel-shaped second yoke in opposed relation to said armature, said armature having a projection engageable with said second yoke.

* * * * *